US010294081B2

(12) United States Patent
Wang

(10) Patent No.: US 10,294,081 B2
(45) Date of Patent: May 21, 2019

(54) ESCALATOR BRAKING SYSTEM AND ESCALATOR BRAKING CONTROL METHOD

(71) Applicant: Otis Elevator Company, Farmington, CT (US)

(72) Inventor: LongWen Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/491,215

(22) Filed: Apr. 19, 2017

(65) Prior Publication Data

US 2017/0305723 A1 Oct. 26, 2017

(30) Foreign Application Priority Data

Apr. 21, 2016 (CN) ..... 2016 1 0249601

(51) Int. Cl.
*B66B 25/00* (2006.01)
*B66B 23/00* (2006.01)
*B66B 29/00* (2006.01)

(52) U.S. Cl.
CPC ..... *B66B 25/006* (2013.01); *B66B 23/00* (2013.01); *B66B 29/00* (2013.01); *B66B 29/005* (2013.01)

(58) Field of Classification Search
USPC ..... 198/322, 323
See application file for complete search history.

(56) References Cited

U.S. PATENT DOCUMENTS 5,323,878 A 6/1994 Nakamura et al.
5,948,035 A 9/1999 Tomita
8,151,950 B2 4/2012 Fargo
(Continued)

FOREIGN PATENT DOCUMENTS

CN 201232008 Y 5/2009
CN 102602758 A 7/2012
(Continued)

OTHER PUBLICATIONS

Al-Sharif, Lutfi et al., "Electrically Based—Intelligent Escalator Braking Systems", Das Magazin, available at http://www.lift-report.de/index.php?mact=News,cntnt01, print,0&cntnt01articleid=740&cntnt01showtemplate=false&cntnt01returnid=556, dated Jul. 9, 2015, 2pgs.

(Continued)

*Primary Examiner* — Gene O Crawford
*Assistant Examiner* — Lester Ill Rushin
(74) *Attorney, Agent, or Firm* — Cantor Colburn LLP

(57) ABSTRACT

The present invention provides an escalator braking system and an escalator braking control method, belonging to the field of escalator braking control technology. In the escalator braking system and the escalator braking control method according to the present invention, a braking mode is determined based on the classification of failure information in combination with the corresponding image information, and a braking device is controlled based on the braking mode, so that the braking is more intelligent, scientific and accurate, the occurrence of security problems caused by the failure can be effectively prevented, and the probability of accident is reduced.

21 Claims, 2 Drawing Sheets

(56) References Cited

U.S. PATENT DOCUMENTS

| | | | | |
|---|---|---|---|---|
| 8,396,588 | B2 * | 3/2013 | Senger | B66B 29/005 700/230 |
| 9,850,101 | B2 * | 12/2017 | Lee | B66B 29/00 |
| 2003/0111902 | A1 | 6/2003 | Thiede et al. | |
| 2007/0170037 | A1 * | 7/2007 | Kuroda | B66B 5/0012 198/322 |
| 2007/0182243 | A1 | 8/2007 | Osborn et al. | |
| 2009/0211998 | A1 | 8/2009 | Gao et al. | |
| 2010/0252379 | A1 | 10/2010 | Piech et al. | |
| 2012/0116574 | A1 * | 5/2012 | Kangas | B66B 25/00 700/230 |

FOREIGN PATENT DOCUMENTS

| | | | |
|---|---|---|---|
| CN | 203319432 | U | 12/2013 |
| CN | 103407850 | B | 5/2015 |
| DE | 102012109390 | A1 | 4/2014 |
| EP | 1419988 | A1 | 5/2004 |
| JP | 2006256763 | A | 9/2006 |
| JP | 2011063434 | A | 3/2011 |
| JP | 2011246230 | A | 12/2011 |
| JP | 2014129156 | A | 7/2014 |
| WO | 2004039717 | A1 | 5/2004 |

OTHER PUBLICATIONS

EP Search Report for application EP 17167622.4, dated Sep. 20, 2017, 7 pages.

* cited by examiner

ESCALATOR BRAKING SYSTEM AND ESCALATOR BRAKING CONTROL METHOD

PRIORITY

This application claims priority to Chinese Patent Application No. 201610249601.5, filed 21 Dec. 2016, and all the benefits accruing therefrom under 35 U.S.C. § 119, the contents of which in its entirety are herein incorporated by reference.

TECHNICAL FIELD

The present invention belongs to the field of escalator braking control technology, and relates to an escalator braking system and escalator braking control method which determine a braking mode based on the classification of failure information in combination with the corresponding image information.

BACKGROUND ART

During operation, the escalator is prone to a safety risk due to various failure problems (e.g., over speed, sudden reversal of running direction, etc.). Therefore, there is a need to monitor the failure information and to control the braking of the escalator to avoid accidents as much as possible when the failure occurs.

At present, the braking of the escalator is mainly performed by braking a rotor of an electric motor for driving the operation of the escalator in a mechanical braking manner, for example, by controlling a brake lining to brake on the rotor of the electric motor. However, this braking method at least has the following problems:

firstly, the braking force of the brake lining needs to be applied by an elastic element such as a spring, in the case of different braking forces, the braking distances are different, and it is relatively difficult to control the braking force and more difficult to achieve the adjustment of the braking force according to the different types of failure; and secondly, the elastic element applying the brake force is unstable, for example, it is easy to change after usage for a certain period of time; therefore, not only the braking distance is not easily controlled, but also the maintenance operation such as adjustment or replacement needs to be often performed on the elastic element.

Moreover, controlling the braking of the escalator only by monitoring the failure information easily results in that the braking control is not applicable to the actual scene of the escalator, which is easy to bring about safety risks.

SUMMARY OF THE INVENTION

In order to solve the above problems or other technical problems, the present invention provides the following technical solutions.

According to an aspect of the present invention, provided is an escalator braking system, comprising a braking device and a failure monitoring device, and further comprising:

- a failure classification module for classifying failure information monitored by the failure monitoring device at least according to braking distance requirements;
- an escalator operation image acquiring and processing device for performing real-time image acquisition of the operation of the escalator and performing processing to obtain image information corresponding to the occurrence of the failure; and
- a braking distance control module for determining a braking mode based on the classification of the failure information in combination with the corresponding image information and controlling the braking device based on the braking mode.

In the escalator braking system according to one embodiment of the present invention, the braking distance control module is further configured to determine a brake mode based on the image information obtained by performing processing when the failure information is not monitored by the failure monitoring device.

In the escalator braking system according to one embodiment of the present invention, the braking mode comprises:

- a short braking distance fast braking mode,
- a medium braking distance normal braking mode, and
- a long braking distance slow braking mode, and/or
- a long braking distance deceleration-to-zero stopping mode.

In the escalator braking system according to one embodiment of the present invention, the classification of the failure information according to the braking distance requirements comprises:

- a short distance fast braking safety failure,
- a long distance slow braking safety failure,
- a medium distance normal braking non-safety failure, and
- a long distance slow braking non-safety failure.

In the escalator braking system according to one embodiment of the present invention, the failure monitoring device comprises:

- a safety chain monitoring module for monitoring a hardware trigger type failure; and
- a first logic failure monitoring module for monitoring a logical failure of the operation of the escalator.

Further, the failure monitoring device also comprises:

- a second logic failure monitoring module for monitoring an internal logic failure of the escalator braking system.

In the escalator braking system according to any of the preceding embodiments, the escalator operation image acquiring and processing device comprises an image sensor and an image processing system, wherein the image information obtained by performing processing by the image processing system comprises whether there is a passenger on the escalator, whether the passenger has a dangerous behavior, and/or whether there is a passenger at the exit or entrance of the escalator.

In one embodiment, the braking distance control module is configured to determine that the braking mode is the short braking distance fast braking mode according to the image information that there is a passenger on the escalator and the passenger has a dangerous behavior.

In the escalator braking system according to one embodiment of the present invention, the braking device is an electrically controlled braking device, comprising:

- a variable frequency driver for controlling the operation of an electric motor for driving the escalator; and
- a brake lining for mechanically braking a rotor of the electric motor;
- wherein the variable frequency driver is configured to control the braking distance based on the determined braking mode.

In the escalator braking system according to one embodiment of the present invention, the braking process corresponding to each braking mode comprises:

- a first braking stage corresponding to controlling a rotational speed of the electric motor by the variable frequency driver to decrease from a normal operating speed to a predetermined speed; and a second braking stage corresponding to performing braking by the brake lining to brake from the predetermined speed to a speed of zero.

In the escalator braking system according to one embodiment of the present invention, the electrically controlled braking device further comprises a main contactor provided between the variable frequency drive controller and the electric motor, wherein, when the rotational speed of the electric motor is lowered to the predetermined speed, the main contactor controls a switch between the variable frequency drive controller and the electric motor to be turned off and at the same time controls the brake lining to perform a braking action on the rotor of the electric motor, thereby achieving a transition from the first braking stage to the second braking stage.

In the escalator braking system according to any of the preceding embodiments, the escalator operation image acquiring and processing device comprises an image sensor and an image processing system.

According to a further aspect of the present invention, provided is an escalator braking control method, comprising the steps of:

classifying monitored failure information at least according to braking distance requirements;

performing real-time image acquisition of the operation of the escalator and performing processing to obtain image information corresponding to the occurrence of the failure;

determining a braking mode based on the classification of the failure information in combination with the corresponding image information; and controlling a braking device based on the braking mode.

In the escalator braking control method according to one embodiment of the present invention, the braking mode comprises:

a short braking distance fast braking mode, a medium braking distance normal braking mode, and a long braking distance slow braking mode, and/or a long braking distance deceleration-to-zero stopping mode.

In the escalator braking control method according to one embodiment of the present invention, the classification of the failure information according to the braking distance requirements comprises:

a short distance fast braking safety failure, a long distance slow braking safety failure, a medium distance normal braking non-safety failure, and a long distance slow braking non-safety failure.

In the escalator braking control method according to one embodiment of the present invention, the method further comprises the steps of:

monitoring a hardware trigger type failure by a safety chain monitoring module; and monitoring a logical failure of the operation of the escalator by a first logic failure monitoring module.

In particular, the escalator braking control method further comprises a step of monitoring an internal logic failure of an escalator braking system by a second logic failure monitoring module.

In one embodiment, the image information comprises whether there is a passenger on the escalator, whether the passenger has a dangerous behavior, and/or whether there is a passenger at the exit or entrance of the escalator.

In one embodiment, in the step of determining a braking mode, it is determined that the braking mode is the short braking distance fast braking mode according to the image information that there is a passenger on the escalator and the passenger has a dangerous behavior.

In the escalator braking control method according to one embodiment of the present invention, the braking device is an electrically controlled braking device, comprising:

a variable frequency driver for controlling the operation of an electric motor for driving the escalator; and a brake lining for mechanically braking a rotor of the electric motor;

wherein the variable frequency driver is configured to control the braking distance based on the determined braking mode.

In the escalator braking control method according to one embodiment of the present invention, the braking process corresponding to each braking mode comprises:

a first braking stage corresponding to controlling a rotational speed of the electric motor by the variable frequency driver to decrease from a normal operating speed to a predetermined speed; and a second braking stage corresponding to performing braking by the brake lining to brake from the predetermined speed to a speed of zero.

In the escalator braking control method according to one embodiment of the present invention, the electrically controlled braking device further comprises a main contactor provided between the variable frequency drive controller and the electric motor, wherein, when the rotational speed of the electric motor is lowered to the predetermined speed, the main contactor controls a switch between the variable frequency drive controller and the electric motor to be turned off and at the same time controls the brake lining to perform a braking action on the rotor of the electric motor, thereby achieving a transition from the first braking stage to the second braking stage.

According to a yet further aspect of the present invention, provided is an escalator braking control method, comprising the steps of:

performing real-time image acquisition of the operation of the escalator and performing processing to obtain image information;

determining a braking mode based on the image information when the failure information is not monitored; and i. controlling a braking device based on the braking mode.

In the escalator braking system and braking control method according to the present invention, a braking mode can be determined not only by depending on the classification of failure information but also by combining the corresponding image information, so that the more intelligent, scientific and accurate braking can be achieved, the occurrence of safety problems caused by the failure can be effectively prevented, and the probability of accident is reduced.

BRIEF DESCRIPTION OF THE DRAWINGS

The foregoing and other objects and advantages of the present invention will become more fully apparent from the following detailed description taken in conjunction with the accompanying drawings.

DETAIL DESCRIPTION

Figure 1:
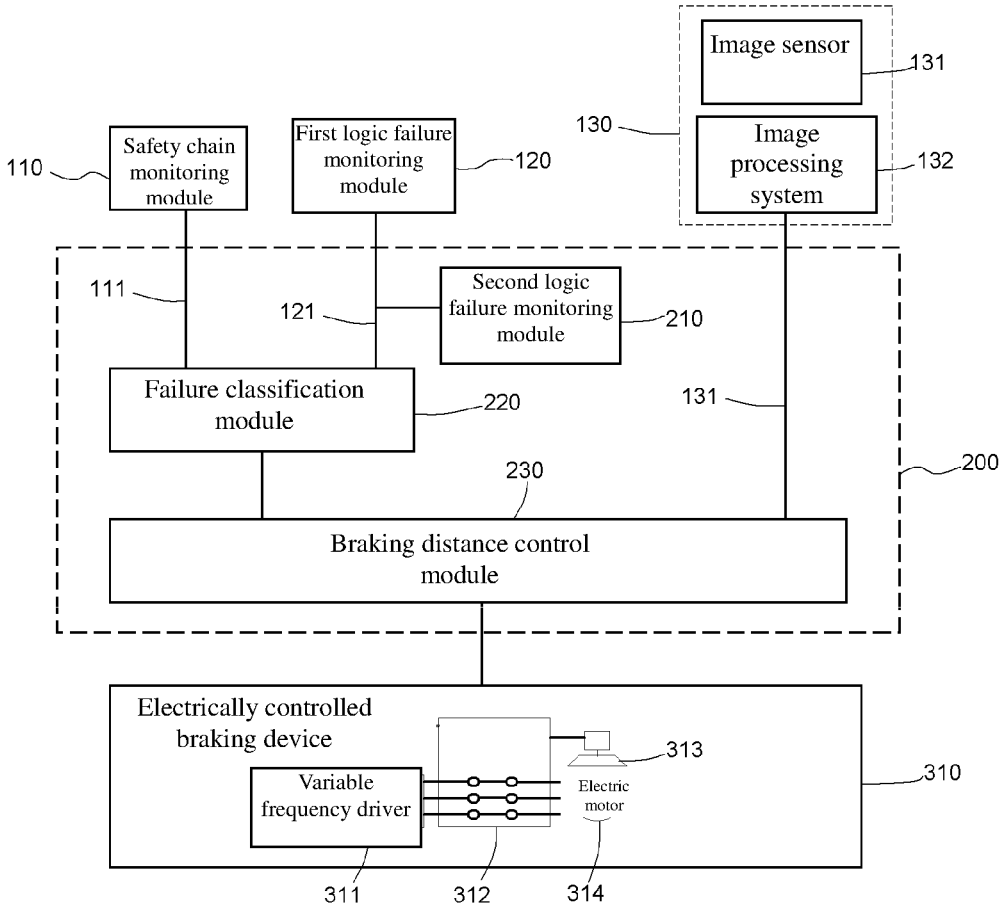
FIG. 1 is a schematic structural view of an escalator braking system according to one embodiment of the present invention.

The present invention will now be described more fully with reference to the accompanying drawings, in which exemplary embodiments of the invention are shown. However, the present invention may be embodied in many different forms and should not be construed as limited to the embodiments set forth herein. On the contrary, these embodiments are provided so that this disclosure will become thorough and complete, and will fully convey the concepts of the present invention to those skilled in the art. In the drawings, the same reference numerals refer to the same elements or parts, and therefore, the description thereof will be omitted.

Some of the block diagrams shown in the figures are functional entities that do not necessarily correspond to physically or logically independent entities. These functional entities may be implemented in software form, or may be implemented in one or more hardware modules or integrated circuits, or may be implemented in different networks and/or processor devices and/or micro-controllers.

The "escalator" in the application not only includes the escalator having steps, but also includes the moving walk without steps.

A schematic structural view of an escalator braking system according to one embodiment of the present invention is shown in FIG. 1. The escalator braking system of this embodiment is used to brake the escalator, in particular by control the braking of a rotor of an electric motor 314 for driving the operation of the escalator, to achieve the braking of the escalator. In the escalator braking system of this embodiment, the braking device thereof employs an electrically controlled braking device 310 so that it can be automatically controlled by means of, for example, a software function module. The electrically controlled braking device 310 is specifically implemented with a variable frequency driver 311, which is possible to control the rotational speed of the electric motor 314 at variable frequencies, so that the variable frequency driver 311 can not only control the rotational speed of the electric motor 314 in the normal operation of the electric motor 314, but can also perform the deceleration control of the electric motor 314 in the braking process to realize the braking of the electric motor 314. In this embodiment, the electrically controlled braking device 310 further comprises a brake lining 313 that can act directly on the rotor of the electric motor 314, thereby ultimately braking the electric motor to a speed of 0. The operation principle of the electrically controlled braking device 310 according to the embodiment of the present invention will be described in detail below.

Continuing referring to FIG. 1, the escalator braking system includes a safety chain monitoring module 110. In this embodiment, a safety chain may consist of a variety of switches, for example, comb switches, handrail strap inlet switches, etc., the specific number and type of the switches are not limited, and those skilled in the art can install various switches and configure them to be monitored in the safety chain, depending on the hardware failure monitored for the specific needs. These hardware switches can be triggered (e.g., triggered off) in real time when a failure occurs, so that the safety chain failure monitoring module 110 can monitor the occurrence of hardware trigger type failure in real time. When the failure is monitored by the safety chain monitoring module 110, the failure information 111 is output, and the failure information 111 is the hardware trigger type failure information.

Continuing referring to FIG. 1, the escalator braking system includes a first logic failure monitoring module 120 for monitoring a variety of safety logical failures occurring in elevator operation control, for example, but not limited to over speed (OS), reversal of running direction (NRD) and other logical failures. The first logic failure monitoring module 120 may, for example, monitor the logical failure of an elevator control system, which is provided outside a core module 200 of the escalator braking system of the embodiment of the present invention. When the failure is monitored, the first logical failure monitoring module 120 outputs the logical failure information 121 to the core module 200.

Continuing referring to FIG. 1, the escalator braking system includes a failure classification module 220, the failure classification module 220 classifies the received failure information 111 and 121, and in this invention, the failure classification module 220 performs classification at least according to braking distance requirements. The "braking distance requirements" refer to respective braking distance range conditions corresponding to the various failures included in the failure information 111 and 121 to be satisfied when the failure occurs to avoid the occurrence of an accident as much as possible. What braking distance does the various failures need to follow can be determined and known in advance, such as the comb switch triggered failure easily leads to safety problems, the corresponding failure requires emergency braking, that is, short distance fast braking, and this failure can be classified as a short distance fast braking safety failure. In one embodiment, various known failure information may be specifically aggregated and pre-classified according to the braking distance requirements, and if a failure is received and belongs to the aggregated failure, the failure is classified in a predetermined classification. It should be noted that as a new failure of the escalator emerges, the new failure update can be aggregated into the above known failure and also pre-classified according to the braking distance requirements.

It should be noted that the braking distance is the running distance when the escalator decelerates from the normal operating speed to substantially zero, and meanwhile the braking distance reflects the braking time. The shorter the braking time, i.e., the faster the braking and the shorter the braking distance; otherwise, the longer the braking distance. It should be understood that the normal operating speed of the escalator also affects the braking distance.

In one embodiment, the failure information 111 and 121 include the following four types according to the braking distance requirements, namely type 1: short distance fast braking safety failure, type 2: long distance slow braking safety failure, type 3: medium distance normal braking non-safety failure, and type 4: long distance slow braking non-safety failure. In the above classification, the safety failure refers to a failure that is relatively easy to cause a safety problem, which generally requires the short distance fast braking, or requires the long distance slow braking to avoid safety problems (e.g., the long distance slow braking may prevent the passengers from falling), whereas the non-safety failure refers to a failure that generally does not lead to a safety problem, and may be based on the medium distance normal braking or long distance slow braking. In the above four types, "short distance", "medium distance", "long distance" refer to the required braking distances, which are relatively defined, and you can define a range of braking distance as the "medium distance", a further range of the braking distance that is smaller than the range of the "medium distance" as the "short distance", and a yet further range of the braking distance that is larger than the range of the "medium distance" as the "long distance". Each of the failure information 111 and 121 may be classified as one of types 1 to 4 above.

Continuing referring to FIG. 1, the escalator braking system further includes an image sensor 131 and an image processing system 132, and the image sensor 131 and the image processing system 132 mainly constitute the escalator operation image acquiring and processing device 130 of the escalator braking system. The image sensor 131 may be mounted at an exit or an entrance or the like of the escalator, there may be one or more image sensors, and the image sensor 131 may perform a real-time image acquisition of the operation of the escalator; and the image sensor 131 may be specifically a 3D sensor, for example, either a RGB-D (three primary colors plus distance) sensor, or a 2D intelligent network camera (SMART IP CAMERA). The image processing system 132 performs image processing based on the image acquired by the image sensor 131 so as to obtain image information corresponding to the occurrence of the failure, for example, whether or not there is a passenger on the escalator, whether the passenger has a dangerous behavior, and/or whether there is a passenger at the exit or entrance of the escalator and other image information are/is obtained based on the image processing, even whether the passenger is a child or an elder needing to be guarded, whether the passenger carries a pet, etc. can be obtained by processing, and the final image information obtained by image processing can be specifically set based on the braking distance required to be adjusted according to the various failure circumstances in a variety of specific situations.

In the image processing process, for example, the body shape information can be obtained from the image and is analyzed and processed so as to substantially identify whether each passenger is one of the three classified passengers, namely the child, the adult or the elder, and also to identify the presence of a dangerous behavior (e.g., leaning against a handrail). It should be noted that in this embodiment, various image processing techniques which may have been or may be present in the future of the present application may be applied to perform image processing to obtain the image information corresponding to the occurrence of a failure, and the image processing techniques specifically used are not limiting.

It should be noted that the image processing system 132 may be provided separately from the image sensor 131, for example, the image processing system 132 may be implemented by a server on which an image processing software is installed; and the image processing system 132 may be provided integrally with respect to the image sensor 131, for example, an intelligent camera terminal can simultaneously acquire an image and perform image processing in the terminal to obtain the image information.

Continuing referring to FIG. 1, the escalator braking system further includes a braking distance control module 230. In particular, the braking distance control module 230 may obtain the classification information output from the failure classification module 220 and the corresponding failure information, and can also obtain the image information output from the image processing system 132 by perform processing. The inventors of the present application have found that the braking distance control module 230 is likely to be inaccurate if the braking control is only based on the type of the failure information, for example, if an object is caught in the handrail strap during the operation of the escalator, the safety chain monitoring module 110 will monitor the failure information and may deem same to be a safety failure that a finger of the passenger is caught in the handrail strap, which is classified as the failure information of type 1 in the failure classification module 220. If the classification is dependent only on type 1, it may be necessary to use the short braking distance fast braking mode, but in fact the object is not the passenger's finger, therefore, it may not lead to a safety problem, taking the normal braking mode is OK.

Therefore, in the present application, the braking distance control module 230 not only determines the braking mode based on the classification of the failure information, but also determines the braking mode in conjunction with the corresponding image information, so that a more intelligent, scientific and accurate braking mode can be obtained. The image information can reflect various scenes on site of the operation of the escalator when a failure occurs, for example, whether or not there is a person, whether or not there is a child, whether or not there is a dangerous behavior, etc., so that the corresponding braking mode determined based on the classification of the failure information can be corrected. In this way, the braking is more effective, the occurrence of safety problems caused by the failure can be effectively prevented, and the probability of accident is reduced.

In one embodiment, the braking mode may be divided into, but is not limited to, the following three types, i.e., a first braking mode: a short braking distance fast braking mode, a second braking mode: a medium braking distance normal braking mode, and a third braking mode: a long braking distance slow braking mode. In another embodiment, the braking mode may further include a fourth braking mode, i.e., a fourth braking mode: a long braking distance deceleration-to-zero stopping mode.

In the above four braking modes, "short distance", "medium distance", "long distance" refer to the actual braking distances, which are relatively defined, and you can define a range of braking distance as the "medium distance", a further range of the braking distance that is smaller than the range of the "medium distance" as the "short distance", and a yet further range of the braking distance that is larger than the range of the "medium distance" as the "long distance". The specific range values are related to the normal operating speed, the type of the escalator and so on.

In the case of not taking into account the image information, if the failure type is type 1, the first braking mode will be used, if the failure type is type 2, the third braking mode will be used, if the failure type is type 3, the second braking mode will be used, and if the failure type is type 4, the second braking mode will be used. In this embodiment, the braking mode will be further corrected and determined in combination with the specific image information, and the following Table 1 gives an example of how to adjust and determine the final braking mode based on the image information.

TABLE 1

| Failure has occurred? | Failure type | whether or not a passenger is on the escalator? | whether or not the passenger has a dangerous behavior? | whether or not a child is at the entrance or exit of the escalator? | Braking mode |
|---|---|---|---|---|---|
| Yes | Type 1 | Yes | Yes | N/A | First braking mode |
| | (short distance | No | Yes | N/A | First braking mode |
| | fast braking | Yes | No | N/A | First braking mode |
| | safety failure) | No | No | N/A | Second braking mode |
| | Type 2 | Yes | Yes | N/A | First braking mode |
| | (long distance | No | Yes | N/A | Third braking mode |
| | slow braking | Yes | No | N/A | Third braking mode |
| | safety failure) | No | No | N/A | Second braking mode |
| | Type 3 | Yes | Yes | N/A | First braking mode |
| | (medium distance | No | Yes | N/A | Second braking mode |
| | normal braking | Yes | No | N/A | Second braking mode |
| | non-safety failure) | No | No | N/A | Second braking mode |
| | Type 4 | Yes | Yes | N/A | First braking mode |
| | (long distance | No | Yes | N/A | Third braking mode |
| | slow braking non- | Yes | No | N/A | Third braking mode |
| | safety failure) | No | No | N/A | Second braking mode |
| No | N/A | Yes | Yes | Both | First braking mode |
| | | No | Yes | Both | First braking mode |
| | | Yes | No | Yes | Fourth braking mode |
| | | Yes | No | No | In operation |
| | | No | No | Yes | Fourth braking mode |
| | | No | No | No | In operation |

In the example of Table 1 above, "whether or not a passenger is on the escalator", "whether or not the passenger has a dangerous behavior", "whether or not a child is at the entrance or exit of the escalator" etc. can be obtained directly or indirectly from the image processing system 132, which are image information content or elements corresponding to the occurrence of the failure. However, it should be understood that the image information is not limited to the image information content or elements in the above example, and that other image information contents or elements that determine the braking mode can be added according to the specific requirements.

Moreover, in the example of Table 1 above, when no failure occurs, that is, when the braking distance control module 230 does not receive the failure information or the classification of the failure information, the braking mode is determined only based on the specific real-time image information during the operation of the escalator.

The braking distance control module 230 may further control the electrically controlled braking device 310, in particular the variable frequency driver 311 of the electrically controlled braking device 310, based on the determined braking mode, so as to achieve accurate braking within the respective braking distance range.

Continuing referring to FIG. 1, in one embodiment, the escalator braking system further includes a second logic failure monitoring module 210 for monitoring the internal logic failure of the escalator braking system, in particular the second logical failure monitoring module 210 is placed within the core module 200, which is primarily composed of the failure classification module 220 and the braking distance control module 230. For example, when the core module 200 is implemented by a software, the second logical failure monitoring module 210 is placed inside the software to monitor the internal logic failure of the software. The failure information monitored by the second logic failure monitoring module 210 is the logical failure information 121, which is also output to the failure classification module 220 to be similarly subjected to the failure classification process.

The operation principle of the electrically controlled braking device 310 according to the embodiment of the present invention will be described in detail with reference to FIGS. 1 and 2.

In one embodiment, a main contactor 312 is provided between the variable frequency drive controller 311 and the electric motor 314 in the electrically controlled braking device 310, and the main contactor 312 is operable to control a switch for a three-phase electric wire between the variable frequency drive controller 311 and the electric motor 314 to be switched off, and to control the brake lining 313 to brake the rotor of the electric motor 314.

Figure 2:
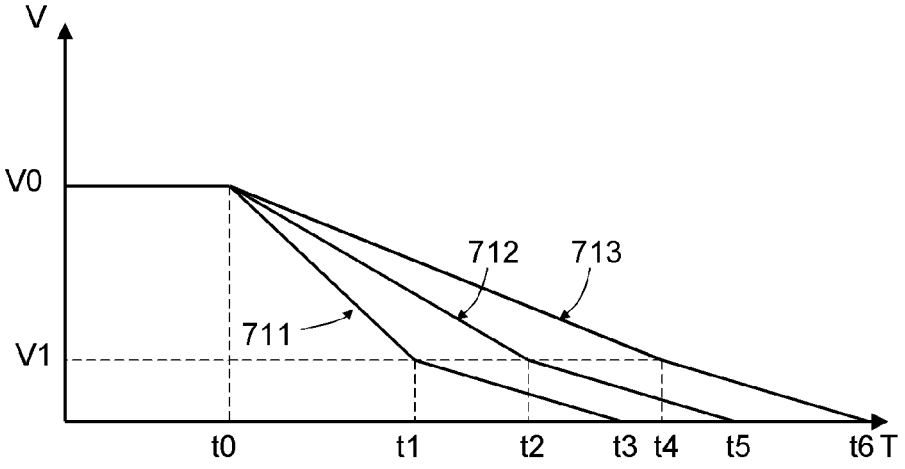
FIG. 2 is a schematic diagram of the operation principle of an electrically controlled braking device of the escalator braking system of the embodiment shown in FIG. 1.

Braking curves of three different braking modes are shown in FIG. 2, wherein a curve 711 is a schematic view of the braking curve of the first braking mode above, a curve 712 is a schematic view of the braking curve of the second braking mode above, and a curve 713 is a schematic view of the braking curve of the third braking mode above. The ordinate indicates the escalator operating speed V (or reflects the electric motor operating speed), and the abscissa represents the time T, assuming that the braking is started from the normal operating speed V0 and finally the speed is braked to 0.

The above curves 711 to 713 correspond to any braking mode in which the braking process includes two braking stages, i.e., a first braking stage corresponding to controlling the rotational speed of the electric motor 314 by the variable frequency driver 311 to decrease from the normal operating speed V0 to a predetermined speed V1, and a second braking stage corresponding to performing braking by the brake lining 313 to brake from the predetermined speed V1 to a speed of zero. The braking principle of the first braking stage is the same as the principle of braking by the variable frequency driver during the braking of an elevator car.

For the curve 711, the t0-t1 stage is the first braking stage in which the variable frequency drive 311 controls the rotational speed of the electric motor 314 to decrease from the speed V0 to the predetermined speed V1, the time period of t0-t1 is relatively short, the braking speed is fast and the braking distance is relatively short; at t1, the main contactor 312 is triggered to turn off the switch of the three-phase electric wire between the variable frequency drive controller 311 and the electric motor 314 and simultaneously enable the brake lining 313 to fall on and brake the rotor of the electric motor 314 to enter the second braking stage of the mechanical braking in the t1-t3 stage; and in the second braking stage, the braking is performed by the brake lining 313 to brake from the predetermined speed V1 to the speed of zero.

For the curve 712, the t0-t2 stage is the first braking stage in which the variable frequency drive 311 controls the rotational speed of the electric motor 314 to decrease from the speed V0 to the predetermined speed V1, the time period of t0-t2 is relatively medium, and therefore the braking distance is a medium braking distance; at t2, the main contactor 312 is triggered to turn off the switch of the three-phase electric wire between the variable frequency drive controller 311 and the electric motor 314 and simultaneously enable the brake lining 313 to fall on and brake the rotor of the electric motor 314 to enter the second braking stage of the mechanical braking in the t2-t5 stage; and in the second braking stage, the braking is performed by the brake lining 313 to brake from the predetermined speed V1 to the speed of zero.

For the curve 713, the t0-t4 stage is the first braking stage in which the variable frequency drive 311 controls the rotational speed of the electric motor 314 to decrease from the speed V0 to the predetermined speed V1, the time period of t0-t4 is relatively long, the braking speed is slow and the braking distance is a relatively long braking distance; at t4, the main contactor 312 is triggered to turn off the switch of the three-phase wire between the variable frequency drive controller 311 and the electric motor 314 and simultaneously enable the brake lining 313 to fall on and brake the rotor of the electric motor 314 to enter the second braking stage of the mechanical braking in the t4-t6 stage; and in the second braking stage, the braking is performed by the brake lining 313 to brake from the predetermined speed V1 to the speed of zero.

In the three braking modes above, the braking in the second braking stage is substantially the same, and the braking time corresponding to the second braking stage is substantially the same, and the braking distance is also substantially the same. Therefore, the control of the braking distance is mainly achieved by the first braking stage, that is, by controlling the variable frequency driver 311. The size of the predetermined speed V1 may be set according to a specific situation, and a predetermined speed V1 or the like may be set so that the braking distance corresponding to the second braking stage can be controlled within a relatively small proportional range (for example, between 15% and 5%).

In the staged braking modes of the above embodiment, the adjustment control of the braking process and the braking distance is mainly performed at the first braking stage, the braking distance of the first braking stage is highly controllable, and the control is accurate. The braking in the second braking stage is the braking from the relatively low speed V1, the braking period is short and has little effect on the accuracy of the overall braking distance, even if there is the unstable problem of the elastic element as described in the background art, a problem that the braking distance control is inaccurate would not occur, the second braking stage corresponds to a shorter period of use of the elastic element, and the maintenance operation such as the adjustment or replacement of the elastic element can be greatly reduced.

It should be noted that the braking curves of the various braking modes are not limited to the linear shapes of the embodiments illustrated above, and may be other shapes such as curve shapes.

Figure 3:
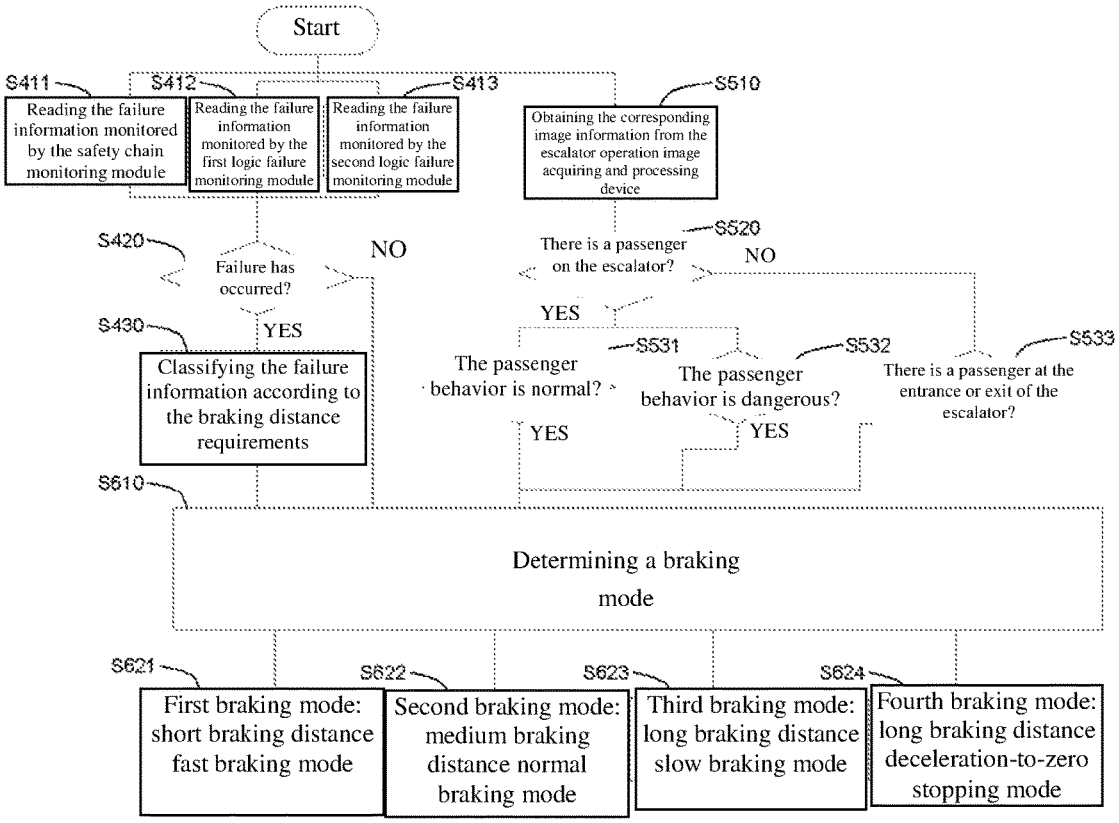
FIG. 3 is a schematic flowchart of an escalator braking control method according to one embodiment of the present invention.

A schematic flowchart of an escalator braking control method according to one embodiment of the present invention is shown in FIG. 3. The braking control method of the embodiment of the present invention will be described in detail with reference to FIGS. 1 and 3.

Firstly, the safety chain monitoring module 110, the first logical failure monitoring module 120 and the second logical failure monitoring module 210 are used to simultaneously monitor the failure information, including, for example, reading the failure information monitored by the safety chain monitoring module 110 (step S411), reading the failure information monitored by the first logical failure monitoring module 120 (step S412), and reading the failure information monitored by the second logical failure monitoring module 210 (step S413).

In step S420, it is determined whether or not the failure has occurred. In this step, if the failure is monitored in the above steps S411, S412, and S413, it indicates that the failure has occurred, and the determination is "YES"; otherwise, it is determined as "NO".

If it is determined as "YES" in step S420, the process proceeds to step S430 where the failure information is classified at least according to the braking distance requirements in the failure classification module 220, for example, classified as the above exemplary type 1, type 2, type 3 or type 4.

On the other hand, the image sensor 131 continuously acquires the real-time image of the operation of the escalator, and the image processing system 131 obtains image information after image processing, that is, in step S510, the corresponding image information is obtained from the escalator operation image acquiring and processing device 130, and the image information 131 is further subjected to analysis processing. For example, if it is determined as "NO" in step S520 of determining whether or not there is a passenger on the escalator, the process proceeds to step S533 to determine whether or not there is a passenger at the entrance or exit of the escalator; and if it is determined as "YES", further determining the passenger behavior, that is, whether or not the passenger behavior is normal is determined in step S531, and whether or not the passenger behavior is dangerous is determined in step S532. The determination results of the above steps S533, S531 and S532 are transmitted to the braking distance control module 230 as part of the image information.

Further, in step S610, the braking mode is determined based on the classification of the failure information in combination with the corresponding image information. In this step, the specific braking mode can be determined in a manner similar to that shown in Table 1 above. In this embodiment, the braking mode comprises a first braking mode: a short braking distance fast braking mode, a second braking mode: a medium braking distance normal braking mode, and a third braking mode: a long braking distance slow braking mode. In another embodiment, the braking mode may further include a fourth braking mode, i.e., a fourth braking mode: a long braking distance deceleration-to-zero stopping mode, and one braking mode can be determined from the above four braking modes.

It should be noted that if it is determined as "NO" in step S420, the process proceeds to step S610, the braking distance control module 230 cannot receive the failure information or the classification of the failure information. In this case, no failure information is monitored by the safety chain monitoring module 110, the first logic failure monitoring module 120 and the second logic failure monitoring module 210 or other failure monitoring modules, the braking distance control module 230 determines the braking mode only based on the specific real-time image information of the operation of the escalator.

Further, the electrically controlled braking device 310 is controlled based on the determined braking mode, that is, the process proceeds to step S621, in which the electrically controlled braking device 310 is controlled based on the first braking mode; or the process proceeds to step S622, in which the electrically controlled braking device 310 is controlled based on the second braking mode; or the process proceeds to step S623, in which the electrically controlled braking device 310 is controlled based on the third braking mode; or the process proceeds to step S624, in which the electrically controlled braking device 310 is controlled based on the fourth braking mode. Step S621, step S622, step S623 and step S624 are alternatively carried out, and the principle of specifically controlling the braking distance is disclosed in the embodiment shown in FIG. 2.

At this point, the braking control method of the embodiments of the present invention is substantially completed.

The above examples mainly describe the escalator braking system and the escalator braking control method of the present invention. Although only some of the embodiments of the present invention have been described, it should be understood by those of ordinary skill in the art that the present invention may be implemented in many other forms without departing from the spirit and scope thereof. The illustrated examples and embodiments are therefore to be considered to be illustrative and not restrictive, and the invention may cover various modifications and substitutions without departing from the spirit and scope of the invention as defined by the appended claims.

What is claimed is:

1. An escalator braking system, comprising a braking device and a failure monitoring device, further comprising:

a failure classification module for classifying failure information monitored by the failure monitoring device at least according to braking distance requirements;

an escalator operation image acquiring and processing device for performing real-time image acquisition of the operation of the escalator and performing processing to obtain image information corresponding to the occurrence of the failure; and a braking distance control module for determining a braking mode based on the classification of the failure information in combination with the corresponding image information and controlling the braking device based on the braking mode;

wherein the braking distance control module is further configured to determine a brake mode based on the image information obtained by performing processing when the failure information is not monitored by the failure monitoring device.

2. The escalator braking system according to claim 1, wherein the braking mode comprises:

a short braking distance fast braking mode, a medium braking distance normal braking mode, and a long braking distance slow braking mode, and/or a long braking distance deceleration-to-zero stopping mode.

3. An escalator braking system, comprising a braking device and a failure monitoring device, further comprising:

a failure classification module for classifying failure information monitored by the failure monitoring device at least according to braking distance requirements;

an escalator operation image acquiring and processing device for performing real-time image acquisition of the operation of the escalator and performing processing to obtain image information corresponding to the occurrence of the failure; and a braking distance control module for determining a braking mode based on the classification of the failure information in combination with the corresponding image information and controlling the braking device based on the braking mode;

wherein the classification of the failure information according to the braking distance requirements comprises:

a short distance fast braking safety failure, a long distance slow braking safety failure, a medium distance normal braking non-safety failure, and a long distance slow braking non-safety failure.

4. The escalator braking system according to claim 1, wherein the failure monitoring device comprises:

a safety chain monitoring module for monitoring a hardware trigger type failure; and a first logic failure monitoring module for monitoring a logical failure of the operation of the escalator.

5. An escalator braking system, comprising a braking device and a failure monitoring device, further comprising:

a failure classification module for classifying failure information monitored by the failure monitoring device at least according to braking distance requirements;

an escalator operation image acquiring and processing device for performing real-time image acquisition of the operation of the escalator and performing processing to obtain image information corresponding to the occurrence of the failure; and a braking distance control module for determining a braking mode based on the classification of the failure information in combination with the corresponding image information and controlling the braking device based on the braking mode;

wherein the failure monitoring device comprises:

a safety chain monitoring module for monitoring a hardware trigger type failure; and a first logic failure monitoring module for monitoring a logical failure of the operation of the escalator;

wherein the failure monitoring device further comprises:

a second logic failure monitoring module for monitoring an internal logic failure of the escalator braking system.

6. An escalator braking system, comprising a braking device and a failure monitoring device, further comprising:

a failure classification module for classifying failure information monitored by the failure monitoring device at least according to braking distance requirements;

an escalator operation image acquiring and processing device for performing real-time image acquisition of the operation of the escalator and performing processing to obtain image information corresponding to the occurrence of the failure; and a braking distance control module for determining a braking mode based on the classification of the failure information in combination with the corresponding image information and controlling the braking device based on the braking mode wherein the escalator operation image acquiring and processing device comprises an image sensor and an image processing system, wherein the image information obtained by performing processing by the image processing system comprises whether there is a passenger on the escalator, whether the passenger has a dangerous behavior, and/or whether there is a passenger at the exit or entrance of the escalator.

7. The escalator braking system according to claim 6, wherein the braking distance control module is configured to determine that the braking mode is the short braking distance fast braking mode according to the image information that there is a passenger on the escalator and the passenger has a dangerous behavior.

8. An escalator braking system, comprising a braking device and a failure monitoring device, further comprising:

a failure classification module for classifying failure information monitored by the failure monitoring device at least according to braking distance requirements;

an escalator operation image acquiring and processing device for performing real-time image acquisition of the operation of the escalator and performing processing to obtain image information corresponding to the occurrence of the failure; and a braking distance control module for determining a braking mode based on the classification of the failure information in combination with the corresponding image information and controlling the braking device based on the braking mode;

wherein the braking device is an electrically controlled braking device, comprising:

a variable frequency driver for controlling the operation of an electric motor for driving the escalator; and a brake lining for mechanically braking a rotor of the electric motor;

wherein the variable frequency driver is configured to control the braking distance based on the determined braking mode;

wherein the braking process corresponding to each braking mode comprises:

a first braking stage corresponding to controlling a rotational speed of the electric motor by the variable frequency driver to decrease from a normal operating speed to a predetermined speed; and a second braking stage corresponding to performing braking by the brake lining to brake from the predetermined speed to a speed of zero.

9. The escalator braking system according to claim 8, wherein the electrically controlled braking device further comprises a main contactor provided between the variable frequency drive controller and the electric motor, wherein, when the rotational speed of the electric motor is lowered to the predetermined speed, the main contactor controls a switch between the variable frequency drive controller and the electric motor to be turned off and at the same time controls the brake lining to perform a braking action on the rotor of the electric motor, thereby achieving a transition from the first braking stage to the second braking stage.

10. The escalator braking system according to claim 1, wherein the escalator operation image acquiring and processing device comprises an image sensor and an image processing system.

11. An escalator braking control method, comprising:

classifying monitored failure information at least according to braking distance requirements;

performing real-time image acquisition of the operation of the escalator and performing processing to obtain image information corresponding to the occurrence of the failure;

determining a braking mode based on the classification of the failure information in combination with the corresponding image information; and controlling a braking device based on the braking mode.

12. The escalator braking control method according to claim 11, wherein the braking mode comprises:

a short braking distance fast braking mode, a medium braking distance normal braking mode, and a long braking distance slow braking mode, and/or a long braking distance deceleration-to-zero stopping mode.

13. The escalator braking control method according to claim 11, wherein the classification of the failure information according to the braking distance requirements comprises:

a short distance fast braking safety failure, a long distance slow braking safety failure, a medium distance normal braking non-safety failure, and a long distance slow braking non-safety failure.

14. The escalator braking control method according to claim 11, further comprising:

monitoring a hardware trigger type failure by a safety chain monitoring module; and monitoring a logical failure of the operation of the escalator by a first logic failure monitoring module.

15. The escalator braking control method according to claim 14, further comprising monitoring an internal logic failure of an escalator braking system by a second logic failure monitoring module.

16. The escalator braking control method according to claim 11, wherein the image information comprises whether there is a passenger on the escalator, whether the passenger has a dangerous behavior, and/or whether there is a passenger at the exit or entrance of the escalator.

17. The escalator braking control method according to claim 16, wherein in determining a braking mode, it is determined that the braking mode is the short braking distance fast braking mode according to the image information that there is a passenger on the escalator and the passenger has a dangerous behavior.

18. The escalator braking control method according to claim 11, wherein the braking device is an electrically controlled braking device, comprising:

a variable frequency driver for controlling the operation of an electric motor for driving the escalator; and a brake lining for mechanically braking a rotor of the electric motor;

wherein the variable frequency driver is configured to control the braking distance based on the determined braking mode.

19. The escalator braking control method according to claim 18, wherein the braking process corresponding to each braking mode comprises:

a first braking stage corresponding to controlling a rotational speed of the electric motor by the variable frequency driver to decrease from a normal operating speed to a predetermined speed; and a second braking stage corresponding to performing braking by the brake lining to brake from the predetermined speed to a speed of zero.

20. The escalator braking control method according to claim 19, wherein the electrically controlled braking device further comprises a main contactor provided between the variable frequency drive controller and the electric motor, wherein, when the rotational speed of the electric motor is lowered to the predetermined speed, the main contactor controls a switch between the variable frequency drive controller and the electric motor to be turned off and at the same time controls the brake lining to perform a braking action on the rotor of the electric motor, thereby achieving a transition from the first braking stage to the second braking stage.

21. An escalator braking control method, comprising:

performing real-time image acquisition of the operation of the escalator and performing processing to obtain image information;

determining a braking mode based on the image information when failure information is not monitored; and controlling a braking device based on the braking mode.

* * * * *